US008850876B2

(12) United States Patent
Ertz et al.

(10) Patent No.: US 8,850,876 B2
(45) Date of Patent: Oct. 7, 2014

(54) METHODS AND SYSTEMS FOR MONITORING ENGINE OIL TEMPERATURE OF AN OPERATING ENGINE

(75) Inventors: Timothy Ertz, Scottsdale, AZ (US); Mike Baron, Phoenix, AZ (US); Anthony Restivo, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 189 days.

(21) Appl. No.: 13/553,516

(22) Filed: Jul. 19, 2012

(65) Prior Publication Data

US 2014/0020460 A1 Jan. 23, 2014

(51) Int. Cl.
*G01M 15/14* (2006.01)

(52) U.S. Cl.
USPC ..... 73/114.55

(58) Field of Classification Search
CPC .. G01M 15/042; G01M 15/048; G01M 15/14
USPC ..... 73/114.55, 114.56
See application file for complete search history.

(56) References Cited

U.S. PATENT DOCUMENTS

| | | | | |
|---|---|---|---|---|
| 4,500,966 | A | 2/1985 | Zagranski et al. | |
| 4,696,156 | A | 9/1987 | Burr et al. | |
| 4,705,100 | A | 11/1987 | Black et al. | |
| 4,839,831 | A * | 6/1989 | Imajo et al. | 73/53.05 |
| 5,121,598 | A | 6/1992 | Butler | |
| 5,553,449 | A | 9/1996 | Rodgers et al. | |
| 6,327,900 | B1 * | 12/2001 | Mc Donald et al. | 73/114.55 |
| 6,449,538 | B1 * | 9/2002 | Kubo et al. | 701/29.5 |
| 6,513,368 | B2 * | 2/2003 | Bondarowicz et al. | 73/53.05 |
| 7,062,370 | B2 | 6/2006 | Vhora et al. | |
| 7,107,828 | B2 * | 9/2006 | Falkowski et al. | 73/114.57 |
| 7,188,514 | B2 * | 3/2007 | Blomkvist et al. | 73/53.05 |
| 7,805,947 | B2 | 10/2010 | Moulebhar | |
| 7,979,192 | B2 | 7/2011 | Morrison et al. | |
| 8,050,814 | B2 * | 11/2011 | Rains et al. | 701/29.5 |

(Continued)

FOREIGN PATENT DOCUMENTS

RU 2287074 C2 11/2006

OTHER PUBLICATIONS

Streifinger, H.; Fuel/Oil System Thermal Management in Aircraft Turbine Engines; Paper presented at the RTO AVT Symposium on "Design Principles and Methods for Aircraft Gas Turbine Engines", held in Toulouse, France, May 11-15, 1998, and published in RTO MP-8.

*Primary Examiner* — Eric S McCall
(74) *Attorney, Agent, or Firm* — Ingrassia Fisher & Lorenz P.C.

(57) ABSTRACT

Systems and methods for monitoring engine oil temperatures to detect higher than normal oil temperatures are provided. The system comprises a plurality of sensors for obtaining input signals from the operating engine for a predetermined set of engine conditions. At least one of the plurality of sensors includes an oil temperature sensor for measuring an engine oil temperature. The system also includes an engine control unit (ECU) where a plurality of predetermined limit values corresponding to at least one predetermined set of engine operating conditions is stored. The engine control unit is configured to select a predetermined limit value corresponding to a measured set of engine operating conditions, to calculate a maintenance limit value using the selected predetermined limit value, and to compare the measured oil temperature with the maintenance limit value. An output unit outputs a predetermined output depending on the result of the comparison.

19 Claims, 4 Drawing Sheets

(56) References Cited

U.S. PATENT DOCUMENTS 8,109,138 B2 * 2/2012 Han et al. ..... 73/114.55
8,197,131 B2 * 6/2012 Kitajima ..... 374/141
2004/0129251 A1 * 7/2004 Kang et al. ..... 123/396
2006/0235599 A1 10/2006 Mukherjee et al.
2010/0122571 A1 * 5/2010 Han et al. ..... 73/54.01
2013/0218399 A1 * 8/2013 Demaison et al. ..... 701/31.4

* cited by examiner

METHODS AND SYSTEMS FOR MONITORING ENGINE OIL TEMPERATURE OF AN OPERATING ENGINE

TECHNICAL FIELD

The present invention generally relates to aircraft engine operation and maintenance, and more particularly relates to methods and systems for monitoring engine oil temperature of an operating engine.

BACKGROUND

Engine oil is the lifeblood of the turbine engine and proper turbine engine oil system function is vital for engine performance. The turbine engine oil system functions to lubricate and cool the engine bearings, gears, and seals and provides hydraulic power for some auxiliary systems. Maintaining the turbine engine oil system pressure and oil temperature within normal operating limits ensures proper turbine engine oil system function. Oil temperature is generally determined by engine heat rejection (i.e., the amount of heat that the engine puts into the engine oil), generator heat rejection (i.e., the amount of heat that the engine generator puts into the engine oil), and oil cooler system performance. Higher than normal oil temperatures may be caused by, for example, low oil, insufficient or ineffective oil cooling (from, for example, oil cooler clogging), blocked oil lines, and/or the engine may be producing too much heat. Certain aircraft and engine operating conditions, environmental conditions, and unique engine characteristics impact oil temperature. Oil temperature is typically highest at high altitudes, high ambient temperatures, and high loads. Increased levels of air pollution and increased frequency of aircraft taking off from and landing at airports located at higher base level altitudes (at about 15,000 feet) have increased the extent of engines operating at higher than normal oil temperatures.

With conventional aircraft oil systems, a high oil temperature (hereinafter "HOT") fault warning is annunciated in some manner (e.g., fault light, screen, code, etc.) when the engine oil temperature exceeds a single predetermined HOT fault limit that is higher than normal operating temperatures. The single predetermined HOT fault limit is typically provided in the Model Specifications for a particular engine. The single predetermined HOT fault limit is inexact, without taking into consideration actual aircraft and engine operating conditions, environmental conditions, and unique engine characteristics. While a HOT fault warning can be alarming and, in the worst case scenario, may result in an aborted flight, the condition is usually momentary. However, by the time of the HOT fault warning, the engine may have already incurred undesirable wear as a result of engine operation at higher than normal oil temperatures. For example, engine operation at higher than normal oil temperatures may accelerate the accumulation of carbon particles in the engine oil (hereinafter referred to as "oil coking") and the deterioration of oil additives. Increased oil coking may lead to increased seal wear and adversely impacts gear and bearing life. Increased oil coking can also result in removal of the engine from service and can increase engine overhaul costs.

Attempts have been made to monitor engine oil temperatures as part of overall engine condition trend monitoring using computer software. Recorded trend data may be sent to a designated analysis center on the ground for processing and recommendations. Trend monitoring requires investment in developing and purchasing expensive equipment and performing complex statistical analyses based on historical data for assessing overall engine health.

Accordingly, it is desirable to provide methods and systems for monitoring engine oil temperatures of an operating engine. It is also desirable to provide simple and relatively inexpensive monitoring methods and systems to detect higher than normal oil temperatures and provide an early maintenance-required oil temperature (MROT) warning before substantial engine wear has occurred and before the oil temperature reaches the single predetermined HOT fault limit value, thereby resulting in reduced maintenance, overhaul requirements, and engine removals. Furthermore, other desirable features and characteristics of the present invention will become apparent from the subsequent detailed description of the invention and the appended claims, taken in conjunction with the accompanying drawings and this background of the invention.

BRIEF SUMMARY

A system is provided for monitoring engine oil temperature of an operating engine. The system comprises a plurality of sensors for obtaining input signals from the operating engine for a predetermined set of engine conditions. At least one of the plurality of sensors includes an oil temperature sensor for measuring an engine oil temperature. The system also includes an engine control unit where a plurality of predetermined limit values corresponding to at least one predetermined set of engine operating conditions is stored. The engine control unit is configured to select a predetermined limit value corresponding to a measured set of engine operating conditions, to calculate a maintenance limit value using the selected predetermined limit value, and to compare the measured oil temperature with the maintenance limit value. An output unit outputs a predetermined output depending on the result of the comparison.

A method is provided for monitoring engine oil temperature of an operating engine. The method comprises measuring the engine oil temperature to determine a measured value of the measured engine oil temperature. A predetermined set of engine operating conditions is also measured. A predetermined limit value corresponding to the predetermined set of measured engine operating conditions is selected among a stored set of predetermined limit values. A maintenance limit value is calculated from the predetermined limit value and a predetermined error value. The measured engine oil temperature is compared with the maintenance limit value. An output is outputted corresponding to the result of the comparison.

A method is provided for monitoring engine oil temperature of an operating engine. The method comprises measuring the engine oil temperature and a plurality of engine operating conditions. A predetermined limit value for the measured engine oil temperature is selected among stored predetermined limit values corresponding to a predetermined set of measured engine operating conditions. A maintenance limit value is calculated for defining a hot oil temperature (HOT) condition. The maintenance limit value is calculated from the predetermined limit value and a predetermined error value. The HOT condition is detected by comparing a measured value of the measured engine oil temperature with the maintenance limit value. A maintenance-required warning is outputted if the result of the comparison is that the measured value exceeds the maintenance limit value but is less than a single predetermined fault limit value.

Furthermore, other desirable features and characteristics of the methods and systems will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Various exemplary embodiments of the present invention are directed to methods and systems for monitoring engine oil temperatures of an operating engine, enabling detection of higher than normal oil temperatures and providing a maintenance-required oil temperature (MROT) warning before the higher than normal oil temperatures can cause significant and undesirable engine wear. The methods and systems are relatively simple and inexpensive, and rely on actual engine and aircraft operating conditions, environmental conditions, and unique engine characteristics (collectively referred to herein as "variable engine operating conditions" or simply "engine operating conditions"), rather than mere exceedance of a single predetermined HOT fault limit value. As used herein, the term "engine" refers to an aircraft propulsion turbine engine or an auxiliary power unit (APU). As noted previously, the term "higher than normal oil temperatures" or variations thereof as used herein refers to a measured oil temperature that exceeds a maintenance limit value, as hereinafter described. The result can be reduced monitoring costs, reduced engine maintenance and overhaul requirements, and reduced engine removals.

Figure 1:
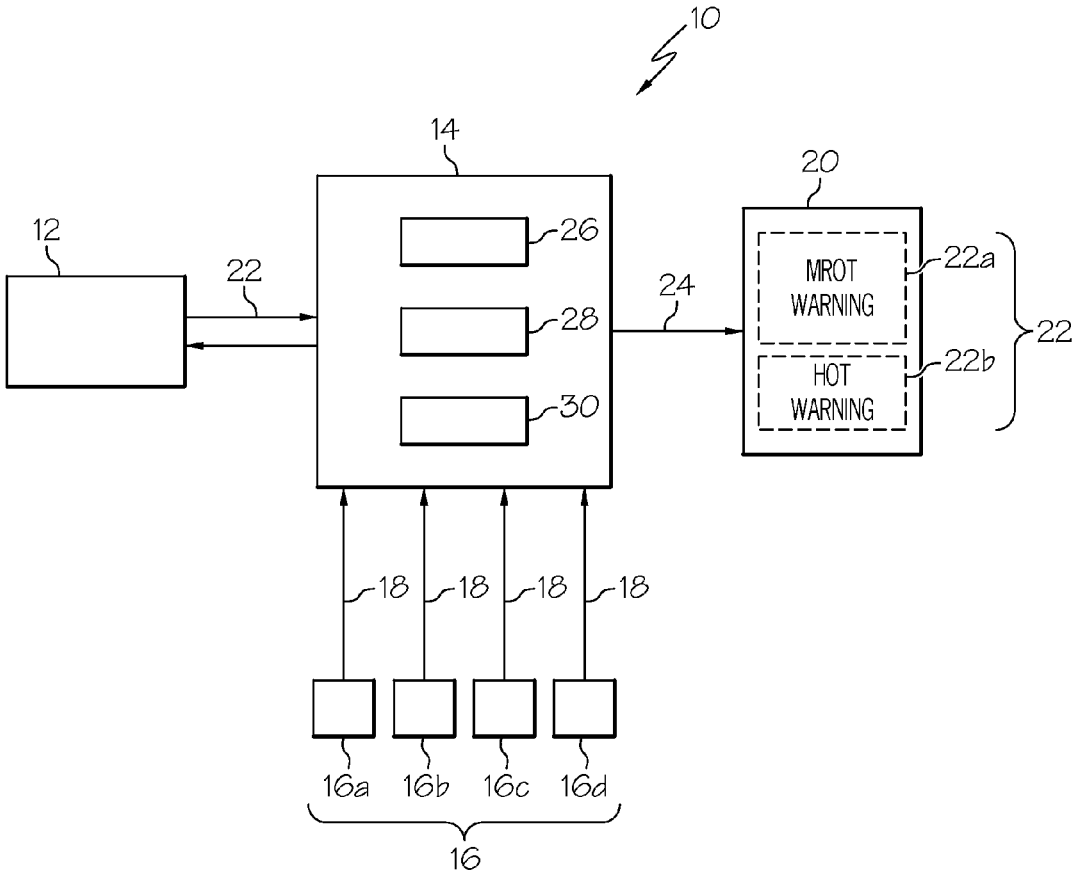
FIG. 1 is a flow chart illustrating a method for monitoring engine oil temperature of an operating engine according to an exemplary embodiment of the present invention.

Referring to a simplified block diagram of a system for monitoring engine oil temperatures in FIG. 1, according to exemplary embodiments, the system 10 comprises an engine 12, an engine control unit (ECU) 14 connected with a plurality of sensors 16 for receiving input signals 18 on engine operating conditions (identified collectively in FIG. 4 as "INPUTS" 15), and an output unit 20, all of which are onboard an aircraft (not shown). The ECU 14 includes a processor, a memory, and other necessary hardware and software components (not shown), as will be understood by persons skilled in the art, to permit the ECU to communicate with the plurality of sensors 16 and execute the control functions as described herein. The methods and systems described herein are not limited to a particular hardware or software configuration. In the exemplary embodiments, the method and systems described herein are performed exclusively by the onboard ECU 14 within a single start-stop cycle of a flight. Processing may be done continuously during engine operation.

The engine control unit (ECU) 14 provides full authority automatic control of the engine 12 in all modes of operation. The ECU continually monitors engine operating conditions to ensure that the engine operates within normal operating limits, as provided in the Model Specification for that engine. Normal operating limits for engine operating conditions such as altitude, ambient, and load, are defined in the Model Specification for the particular engine. Normal operating limits refer to a specific operating envelope (altitude, ambient temperature, Mach number, etc.) for that engine as defined in the Model Specification. The ECU receives electrical input signals 22 from the engine, pilot, or other aircraft inputs (not shown) and data (as input signals 18) from the plurality of sensors 16. The ECU is connected with the plurality of sensors for receiving inputs 14 on engine operating conditions (inclusive of aircraft operating conditions, environmental conditions, and unique engine characteristics) such as, for example, engine output bleed air as applicable, duct pressure, IGVs, and shaft load, Mach no., ambient pressure and temperature, inlet door position (door that feeds outside air to APU inlet and enclosure), exhaust gas temperature (EGT), APU inlet temperature and pressure (calculated), generator load (output from generator), air bleed pressure, surge control valve, etc. The ECU analyzes the input signals 18 and 22 and sends an output signal 24 or ignores the input signals. The ECU automatically adjusts the control conditions for the engine. The ECU operates in the conventional manner, except as indicated herein.

The plurality of sensors may include, for example, an aircraft speed sensor 16*a* for measuring speed of the aircraft, an altitude sensor 16*b* for measuring altitude of the aircraft, an oil temperature sensor 16*c* for measuring engine oil temperature, a load sensor 16*d* for measuring load on the engine, a Mach No. sensor, or the like for measuring each of the engine operating conditions. While four sensors are illustrated in FIG. 1, a fewer or greater number of sensors may be used in the system according to exemplary embodiments. As used herein, the term "sensor" may refer to individual sensors or a complex sensor in which the individual sensors are combined.

Figure 2:
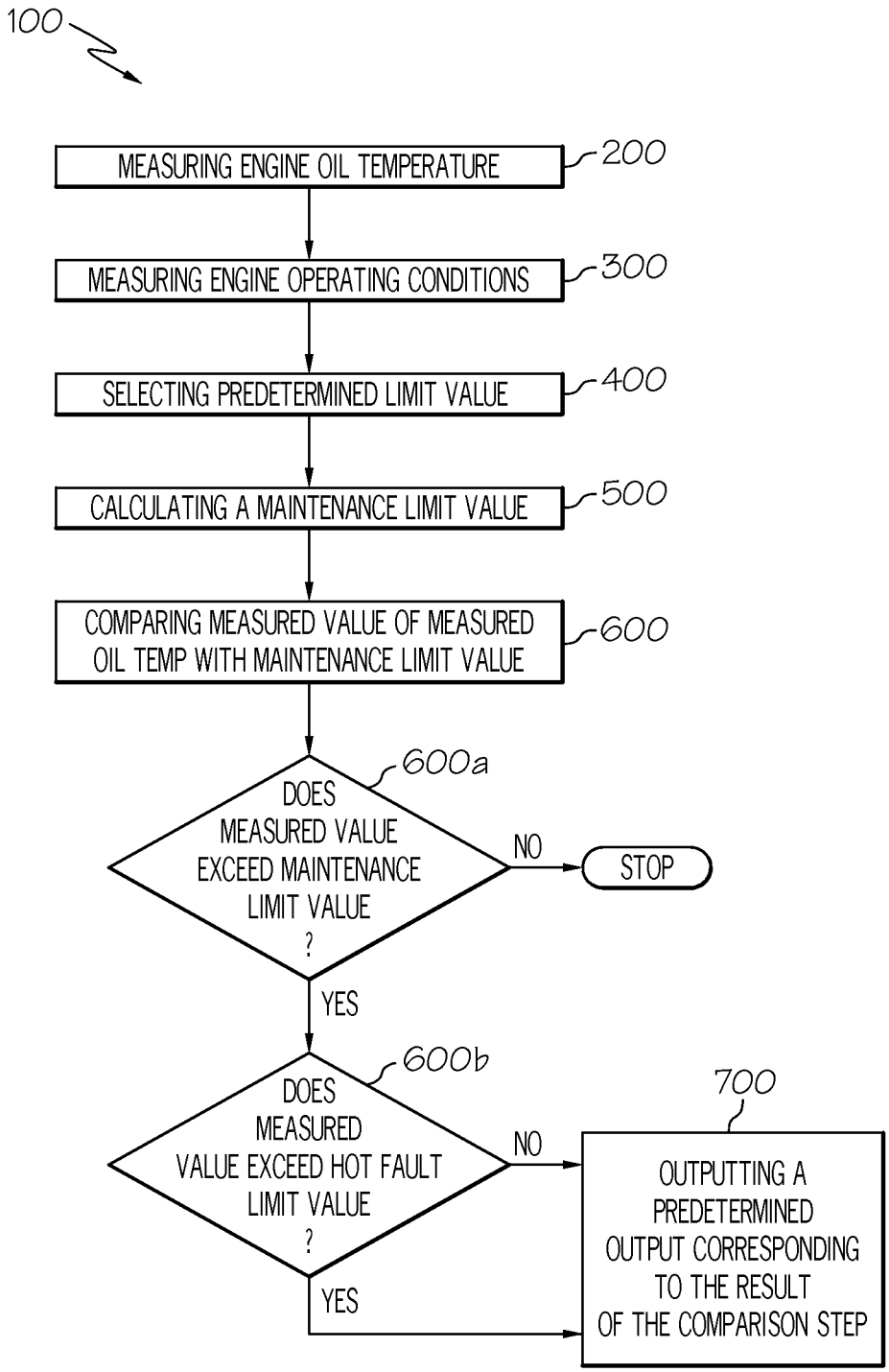
FIG. 2 is a simplified block diagram of a system for monitoring engine oil temperature of an operating engine according to another exemplary embodiment of the present invention.

Referring still to FIG. 1 and now to FIG. 2, in accordance with an exemplary embodiment, a method 100 for monitoring engine oil temperatures in an operating engine begins by measuring an engine oil temperature in the operating engine (step 200). The oil temperature sensor is 16*c* capable of measuring the engine oil temperature to provide an input signal to the ECU 14 with a measured value of the measured engine oil temperature. The input signal for the engine oil temperature is typically in millivolts. The ECU will convert the millivolts into a temperature value with the processor in the ECU. The other input signals into the ECU may or may not be processed by the ECU. According to exemplary embodiments, the oil temperature sensor may detect a higher than normal oil temperature, as hereinafter described.

Method 100 continues by measuring each engine operating condition (such as previously described) of the predetermined set of engine operating conditions (step 300). Like the oil temperature, each engine operating condition is measured by obtaining an input signal from the operating engine for the engine condition. The plurality of sensors obtains input signals from the operating engine for the predetermined set of engine conditions. The ECU contains the necessary processing electronics to process or receive each of the input signals of the sensors. Unlike conventional monitoring systems where the percentage of oil cooler clogging may be an input signal, the methods and systems according to exemplary embodiments help to reduce or substantially prevent oil cooler clogging by detecting higher than normal oil temperatures before significant oil cooler clogging may occur.

Figure 4:
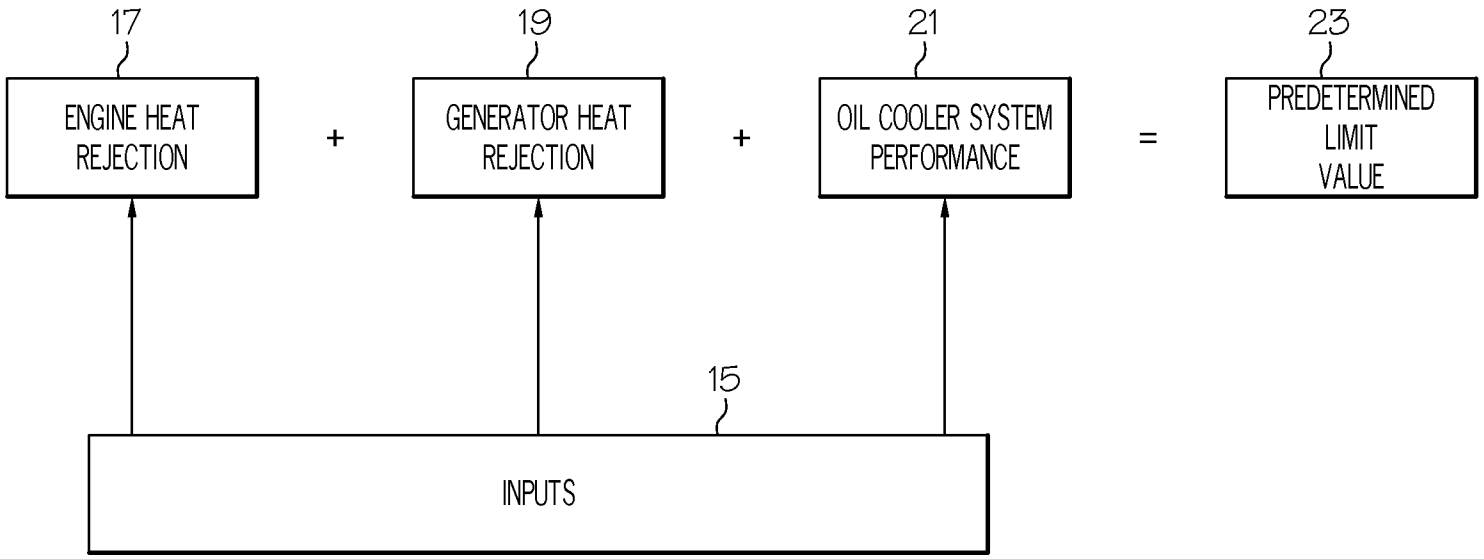
FIG. 4 is a simplified schematic of an algorithm for selecting the predetermined limit value corresponding to a predetermined set of measured engine operating conditions (identified collectively in FIG. 4 as "INPUTS").

Method 100 continues by selecting a predetermined limit value for the engine oil temperature corresponding to the measured engine operating conditions among stored limit values corresponding to the predetermined set of engine conditions (step 400). The information on engine oil temperature and other engine operating conditions (i.e., INPUTS 15 (FIG. 4)) is measured by the plurality of sensors 16 and inputted to the ECU 14, and the inputted information is used by the ECU to select the predetermined limit value for the engine oil temperature in real time depending upon the measured values of at least one predetermined set of engine operating conditions from step 300. A plurality of predetermined limit values of engine oil temperatures corresponding to predetermined sets of engine conditions is stored in the ECU, in advance. Therefore, when information on the measured engine operating conditions is received through the sensors, a corresponding predetermined limit value is selected. The predetermined limit value is based on a set of predetermined engine operating conditions by using an algorithm stored in the ECU as part of the software. The set of predetermined engine operating conditions is specified within the model specification for the engine describing, for example, normal engine operating conditions (e.g., altitude, ambient, load, mach number, etc.). The predetermined limit value is determined by the algorithm based on the measured engine operating conditions. FIG. 4 is a simplified schematic of the algorithm for selecting the predetermined limit value for the measured oil temperature. As noted previously, oil temperature is generally determined by engine heat rejection (i.e., the amount of heat that the engine puts into the engine oil) (Block 17 in FIG. 4), generator heat rejection (i.e., the amount of heat that the engine generator puts into the engine oil) (Block 19 in FIG. 4), and oil cooler system performance (Block 21 in FIG. 4). The sum of the engine heat rejection, generator heat rejection, and oil cooler system performance values determines the predetermined limit value.

The predetermined limit value (Block 23 in FIG. 4) varies and depends on the measured values of the predetermined set of engine operating conditions (referred to in FIG. 4 as "INPUTS" in Block 15). For example, the predetermined limit value is higher when the engine is operating, for example, under higher than normal load, ambient (outside temperature), altitude and Mach No. relative to the same engine operating conditions under normal load, normal outside temperature, and normal Mach No., or the predetermined limit value can be lower when the engine is operating under low load cruise conditions for maximum fuel efficiency. The predetermined limit value takes the actual load on the APU into account and determines what the oil temperature should be based on the plurality of measured engine operating conditions. For example, a measured oil temperature of 230° F. at 15K feet with ambient of 77° F. and 80% Generator Load may be considered a "normal" oil temperature, but the same oil temperature at base level with ambient of 60° F. and 100% generator load may indicate a potential for higher than normal oil temperatures at higher ambient and/or altitude. Each of the inputs has varying impact on engine heat rejection, generator heat rejection, and oil cooler system performance. The impact of each input on each of engine heat rejection, generator heat rejection, and oil cooler system performance may range from zero impact to greater than zero impact. For example, oil cooler system performance is measured by the amount of heat that the oil cooler system can remove from the engine oil. At hotter ambient temperatures, the oil cooler system can remove less heat. At lower altitudes, for example, the oil cooler system can remove more heat.

Normal oil temperatures are determined by testing, analysis, experience, or a combination thereof at normal operating limits or conditions as defined in the Model Specification for the particular engine. The Model Specification for the engine typically does not provide much information on oil temperatures, other than minimum oil temperatures for starting the engine, and HOT fault limit temperatures. In an embodiment, engine trend monitoring may be used to determine normal operating limits. The normal operating limits are based upon estimated "nominal" engine performance. The data for the normal operating limits is analytically based with additional benefit of engine and aircraft test data used to establish a baseline for investigating future, performance-related issues. Normal operating limits may be somewhat amended with field data over time once a significant number of aircraft are in operation.

Figure 3:
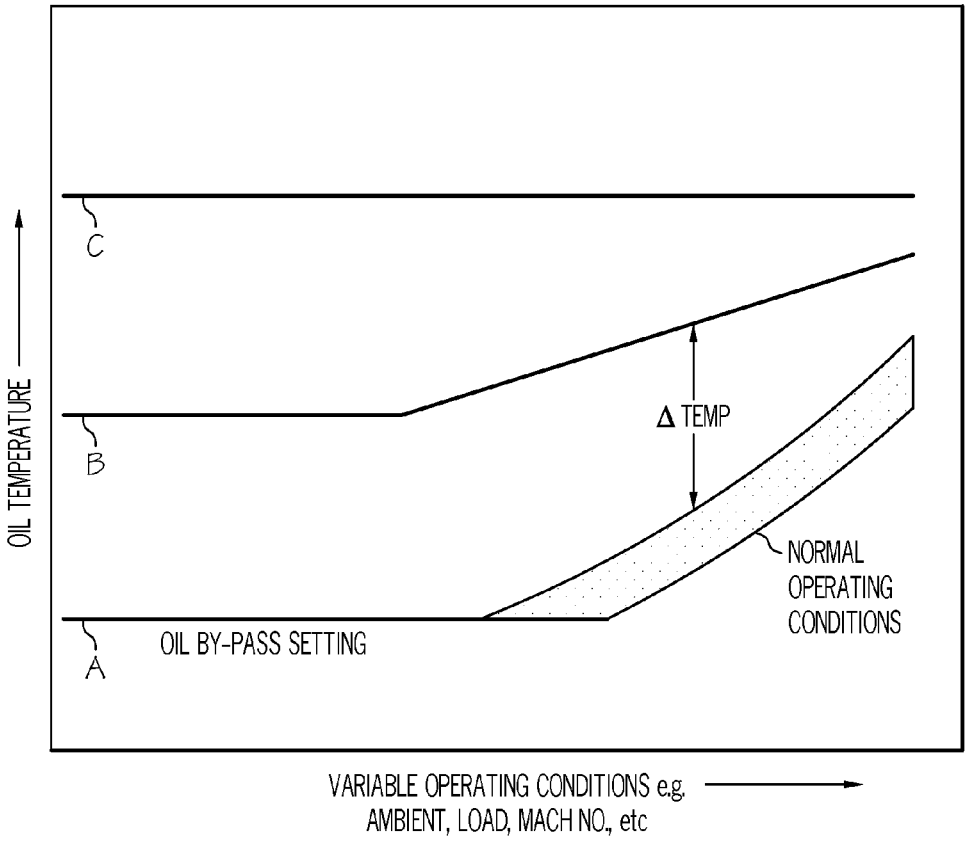
FIG. 3 is a line graph illustrating the oil temperature (Y-axis) increasing as a result of an increase in, for example, such variable engine operating conditions (X-axis) as a higher ambient (outside) temperature, a higher load, a higher Mach No., or a combination thereof, the lowest oil temperatures represented by line A (normal oil temperatures under normal operating conditions), to a maintenance-required oil temperature (MROT) condition, represented by a maintenance limit value (line B) and a high oil temperature (HOT) fault limit value (line C)

Still referring to FIGS. 1 and 2, method 100 continues by calculating a maintenance limit value from the sum of the predetermined limit value and an error value (step 500). The maintenance limit value may also be referred to herein as a "maintenance-required oil temperature (MROT) limit value." Line B in FIG. 3 represents an exemplary maintenance limit value determined in this step. The ECU 14 further comprises a calculator 26 and a Lookup table 28 for the calculation performed in this step. The Lookup table 28 provides the error value to account for reasonable degradation of the engine during operation. The predetermined error value is implemented by the Lookup table within the software to account for the predetermined set of engine operating conditions. The predetermined error value accounts for normal wear and tear and typical oil cooler system deterioration. For example, the engine oil cooling system performance may be somewhat reduced during engine operation. The oil cooler may be at least partially blocked as a result of dust, sand, pollution, and other factors that affect the airflow forced through or pulled through the oil cooler. Bearing wear or seal leakage may also increase engine heat generation during engine operation. Other factors may also result in some degradation of the engine during operation. The error value is represented by ATemp in FIG. 3. The maintenance limit value defines the maximum engine oil temperature that the engine oil is allowed to reach before a maintenance-required output signal corresponding to a maintenance-required oil temperature (MROT) warning 22*a* (FIG. 1) is outputted from the output unit 20, as hereinafter described. The maintenance limit value is not fixed, but "floats" or varies depending upon the sensor signals and the predetermined limit value selected by the ECU in step 400.

Still referring to FIGS. 1 and 2, method 100 continues by comparing the measured value of the measured engine oil temperature with the maintenance limit value calculated in step 500 (step 600). In this regard, the ECU 14 also includes a comparator 30 for comparing the measured value of the measured engine oil temperature from step 200 with the maintenance limit value to determine whether the measured value exceeds the maintenance limit value. In other words, the comparator compares the measured value of the oil temperature measured by the oil temperature sensor with the calculated maintenance limit value calculated in step 500. If the result of decision step 600*a* is answered in the negative, i.e., the measured value of the measured oil temperature does not exceed the maintenance limit value (i.e., the measured value of the measured oil temperature is in the normal oil temperature range below Line B of FIG. 3), the measured value of the measured oil temperature is determined to be within normal or acceptable operating limits (Line A of FIG. 3) and the input signal from the oil temperature sensor may be ignored as indicated by "STOP" in FIG. 2. If the measured value exceeds the maintenance limit value (indicated by the "YES" to decision step 600*a*), a maintenance-required oil temperature (MROT) condition is detected by the ECU and the maintenance-required oil temperature (MROT) warning 22*a* (FIG. 1) is outputted from the output unit 20, as hereinafter described. The oil temperature at an MROT condition is higher than the oil temperature at normal operating conditions, as shown in FIG. 3. As noted previously, the engine may incur undesirable wear as a result of engine operation at higher than normal oil temperature conditions, thereby potentially increasing maintenance costs, overhaul requirements, and contributing to engine removals.

If the result of decision step 600*a* is answered in the affirmative (i.e., that the measured value exceeds the maintenance limit value (decision step 600*a*)), it must then be determined whether the measured value of the measured oil temperature also exceeds a conventional higher HOT fault limit value (decision step 600*b*). The higher HOT fault limit value is a single predetermined value that defines the maximum engine oil temperature that the engine oil is allowed to reach before a HOT fault indication or warning (22*b* in FIG. 1) is provided, as hereinafter described. The single predetermined (HOT) fault limit value is represented by line C in FIG. 3. An exemplary single predetermined fault (HOT) limit value may be 315° F.+/−7° F., but higher or lower fault limit values may be used depending on the engine, and as defined in the Model Specification for that engine. In accordance with exemplary embodiments, and as noted previously, the maintenance limit value floats, but is below the single predetermined HOT fault limit value, i.e., the single predetermined HOT fault limit value will always be higher than the maintenance limit value.

Referring again to FIGS. 1 and 2, method 10 continues by outputting a predetermined output 22 corresponding to the result of the comparison step 600 (including decision steps 600*a* and 600*b*) through an output signal (step 700). Referring again to FIG. 1, and as noted previously, the system 100 further comprises the output unit 20 for outputting the predetermined output 22 corresponding to the result of the comparison step. The output unit 20 may comprise an instrument panel or the like. The predetermined output 22 comprises the MROT warning 22*a* if the result of the comparison step is that the measured value of the measured oil temperature exceeds the maintenance limit value but is below the single predetermined HOT fault limit value. In this case, an output signal corresponding to the MROT warning is outputted from the ECU, according to exemplary embodiments. The ECU outputs the MROT output signal or warning that alerts and warns the pilot and/or ground personnel that a higher than normal oil temperature has been detected and/or that a maintenance limit value has been exceeded, and that oil system or other maintenance action may be required. The majority of MROT warnings will be from clogged oil coolers. For example, the ECU may send a maintenance-required output signal (also referred to herein as a "first signal") for lighting a maintenance lamp in the aircraft instrument panel. The MROT warning may be visual, oral, etc. to alert, warn, and/or convey other information to the pilot and/or ground personnel that higher than normal oil temperatures have been detected and/or that the maintenance limit value has been exceeded, thus providing notification that the maintenance action is required. The maintenance action may be inspection, repair and/or overhaul. The ECU can be interrogated during flight or after the flight is complete for at least troubleshooting the higher than normal oil temperature condition (i.e., the MROT condition).

Alternatively, if the measured value of the measured oil temperature exceeds the higher single predetermined HOT fault limit value (Line C in FIG. 3), a HOT fault output signal (also referred to herein as a "second signal") is outputted from the output unit to provide the HOT fault indication or warning 22*b*, as known in the art. In this case, the ECU may send a fault output signal for lighting a fault lamp in the instrument panel, as is known in the art. The HOT fault output signal can be implemented as a shutdown in the case of a non-essential APU or as a warning only in the case of an essential APU. As noted previously, in the worst case scenario, the HOT fault output signal may result in an aborted flight. However, it is intended that the exemplary embodiments as described herein reduce HOT fault output signals, by detecting a higher than normal oil temperature condition before the engine oil temperature reaches the HOT fault limit value and providing a MROT warning to alert personnel that the maintenance action is required. If the MROT condition is detected, for example, on the ground, at cooler ambient temperatures, etc., it is predictive of a potential HOT fault indication at, for example, higher altitudes. By being alerted prior to ascending to the higher altitude, the HOT fault indication has the potential of being prevented. In addition, the longevity of the seals, bearings, and gears is substantially preserved.

Although the methods and systems have been described relative to aircraft engines, the methods and systems according to exemplary embodiments may be applied to monitoring engine oil temperature in other vehicles where oil temperature monitoring may help reduce monitoring costs, engine maintenance and/or overhaul requirements, and/or engine removals.

Accordingly, a systems and a method for monitoring engine oil temperature of an operating engine have been provided. From the foregoing, it is to be appreciated that the exemplary embodiments of the system and method for monitoring engine oil temperatures of an operating engine are less expensive and simpler than conventional monitoring systems and methods and detect higher than normal oil temperatures early when the engine oil temperature is below the fault limit value, thereby reducing engine maintenance, overhaul requirements, and engine removals.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A system for monitoring engine oil temperature of an operating engine comprising:

a plurality of sensors for obtaining sensor signals from the operating engine for a predetermined set of engine conditions, at least one of the plurality of sensors comprising an oil temperature sensor for measuring an engine oil temperature;

an engine control unit (ECU) where a plurality of predetermined limit values for engine oil temperatures corresponding to at least one predetermined set of engine operating conditions is stored, the engine control unit configured to select a predetermined limit value for the engine oil temperature corresponding to a measured set of engine operating conditions, to calculate a maintenance limit value using the selected predetermined limit value, and to compare the measured engine oil temperature with the maintenance limit value, the maintenance limit value defining a maximum engine oil temperature that the engine oil is allowed to reach before a predetermined warning is outputted; and an output unit capable of outputting the predetermined warning depending on the result of the comparison.

2. The system of claim 1, wherein the predetermined warning comprises a maintenance-required oil temperature (MROT) warning and the engine control unit (ECU) comprises:

a calculator;

a Lookup table; and a comparator for comparing the measured value of the measured engine oil temperature with the maintenance limit value, wherein the output unit outputs the maintenance-required oil temperature (MROT) warning when the measured value of the measured oil temperature exceeds the maintenance limit value but is below a HOT fault limit value.

3. The system of claim 2, wherein the predetermined limit value is determined from an algorithm that is a function of engine heat rejection, generator heat rejection, and oil cooler system performance.

4. The system of claim 2, wherein the maintenance limit value equals a sum of the predetermined limit value and a predetermined error value determined from the Lookup table.

5. A method for monitoring an engine oil temperature in an operating engine, the method comprising the steps of:

measuring the engine oil temperature to determine a measured value of the measured engine oil temperature;

measuring a predetermined set of engine operating conditions;

selecting a predetermined limit value for the engine oil temperature corresponding to the predetermined set of measured engine operating conditions among a stored set of predetermined limit values of engine oil temperatures;

calculating a maintenance limit value from the predetermined limit value and a predetermined error value, the maintenance limit value defining a maximum engine oil temperature that the engine oil is allowed to reach before a predetermined warning is outputted;

comparing the measured engine oil temperature with the maintenance limit value; and outputting the predetermined warning corresponding to the result of the comparison through an output unit.

6. The method of claim 5, wherein the step of measuring a predetermined set of engine operating conditions comprises measuring engine load (bleed and shaft) and two or more of true airspeed, indicated airspeed, pressure altitude, density altitude, outside air temperature, altitude, inlet pressure, outside temperature, inlet temperature, engine shaft speed, oil temperature, and engine exhaust gas temperature.

7. The method of claim 5, wherein the steps of measuring the engine oil temperature and a predetermined set of engine operating conditions comprise obtaining sensor signals from the operating engine.

8. The method of claim 5, wherein the step of selecting a predetermined limit value comprises selecting the predetermined limit value determined from an algorithm that is a function of engine heat rejection, generator heat rejection, and oil cooler system performance.

9. The method of claim 5, wherein the step of calculating a maintenance limit value comprises adding the predetermined limit value and the predetermined error value.

10. The method of claim 5, wherein the step of calculating comprises obtaining the predetermined error value from a Lookup table.

11. The method of claim 5, wherein the step of outputting a predetermined warning comprises outputting a maintenance-required oil temperature (MROT) output signal if the measured engine oil temperature exceeds the maintenance limit value but is less than a single predetermined HOT fault limit value.

12. The method of claim 5, wherein the step of outputting a predetermined warning comprises outputting a first signal if the measured engine oil temperature exceeds the maintenance limit value and outputting a second signal if the measured engine oil temperature exceeds a single predetermined HOT fault limit value.

13. The method of claim 12, wherein the first signal comprises a maintenance-required output signal and the second signal comprises a HOT fault output signal.

14. A method for monitoring engine oil temperature of an operating engine, the method comprising the steps of:

measuring the engine oil temperature;

measuring a plurality of engine operating conditions;

selecting a predetermined limit value for the measured engine oil temperature among stored predetermined limit values corresponding to a predetermined set of measured engine operating conditions;

calculating a maintenance limit value for defining a maintenance-required oil temperature (MROT) condition, the maintenance limit value comprising a sum of the predetermined limit value and a predetermined error value;

detecting the MROT condition by comparing a measured value of the measured engine oil temperature with the maintenance limit value; and outputting a MROT warning if the result of the comparison is that the measured value exceeds the maintenance limit value but is less than a single predetermined HOT fault limit value.

15. The method of claim 14, wherein the step of measuring a predetermined set of engine operating conditions comprises measuring two or more conditions comprising true airspeed, indicated airspeed, pressure altitude, density altitude, outside air temperature, inlet pressure, inlet temperature, engine load (bleed and/or shaft), engine shaft speed, oil temperature, or engine exhaust gas temperature.

16. The method of claim 14, wherein the step of calculating comprises obtaining the predetermined error value from a Lookup table.

17. The method of claim 14, wherein the step of outputting a MROT warning comprises outputting a maintenance-required oil temperature (MROT) output signal if the measured engine oil temperature exceeds a maintenance limit value but is less than the single predetermined HOT fault limit value.

18. The method of claim 14, wherein the step of outputting a MROT warning comprises outputting a first signal if the measured engine oil temperature exceeds the maintenance limit value and outputting a second signal if the measured engine oil temperature exceeds the single predetermined HOT fault limit value, wherein the first signal comprises a maintenance-required output signal and the second signal comprises a HOT fault output signal.

19. The method of claim 14, wherein the step of outputting an output further comprises outputting an output signal that a higher than normal oil temperature has been detected.

* * * * *